United States Patent [19]

Barker et al.

[11] Patent Number: 4,610,193

[45] Date of Patent: Sep. 9, 1986

[54] LOAD CONTROL SYSTEM

[75] Inventors: Gary T. Barker; James A. Miller, both of Cedar Falls, Iowa

[73] Assignee: Deere & Company, Moline, Ill.

[21] Appl. No.: 545,567

[22] Filed: Oct. 26, 1983

[51] Int. Cl.[4] ..... F15B 11/02

[52] U.S. Cl. ..... 91/420; 91/421; 91/436; 91/463

[58] Field of Search ..... 91/420, 445, 447, 451, 91/436, 6, 31, 421, 462, 463; 60/460

[56] References Cited

U.S. PATENT DOCUMENTS

| | | | |
|---|---|---|---|
| 4,004,607 | 1/1977 | Freese | 137/486 |
| 4,037,823 | 7/1977 | Thaeter et al. | 91/433 |
| 4,085,855 | 4/1978 | Worback | 91/420 |
| 4,102,250 | 7/1978 | Schexynader | 91/412 |
| 4,147,093 | 4/1979 | Dunn | 91/510 |
| 4,165,675 | 8/1979 | Cryder et al. | 91/420 |
| 4,167,892 | 9/1979 | Cryder et al. | 91/445 |
| 4,350,078 | 9/1982 | Olofsson | 91/388 |
| 4,466,336 | 8/1984 | Broome et al. | 60/460 |

FOREIGN PATENT DOCUMENTS

| | | | |
|---|---|---|---|
| 2118936 | 2/1973 | Fed. Rep. of Germany | 91/451 |
| 2833971 | 3/1980 | Fed. Rep. of Germany | 91/447 |
| 467411 | 2/1971 | Japan | 91/420 |

*Primary Examiner*—Robert E. Garrett
*Assistant Examiner*—John M. Husar

[57] ABSTRACT

A load control system is disclosed for preventing the uncontrolled lowering of a load should a line failure occur in a hydraulic system. The system is designed to be used with a hydraulic cylinder having a movable piston therein which divides the cylinder into a head end and a rod end. Attached to the piston and extending out of the hydraulic cylinder is a piston rod which has a load secured to its free end. The load control system includes a source of pressurized fluid, the flow of which is selectively controlled to the hydraulic cylinder by a control valve. Positioned between the control valve and the head and rod ends of the hydraulic cylinder, respectively, are first and second valves each of which is normally biased towards a closed position by a common pressure. The first and second valves are urged toward an open position by fluid pressure taken between the control valve and the first valve and are movable by this fluid pressure in a proportional manner with the second valve being opened first. The second valve is also physically mounted directly to the hydraulic cylinder such that if a line breakage occurs, the load will still be unable to drop.

14 Claims, 2 Drawing Figures

LOAD CONTROL SYSTEM

FIELD OF THE INVENTION

This invention relates to a load control system for preventing the uncontrolled lowering of a load should a line failure occur within a hydraulic system.

BACKGROUND OF THE INVENTION

In some industrial equipment, such as a backhoe or an excavator, it is common to support a load in a crane type operation by a structure operated by a hydraulic cylinder. Failure of a line within the system could cause the pressurized hydraulic fluid to escape which could result in the uncontrolled lowering of the load. Such an event could cause serious injury to a person working beneath the load.

Now a load control system has been invented which will prevent the uncontrolled lowering of a load should a line failure occur within the system.

SUMMARY OF THE INVENTION

Briefly, this invention relates to a load control system for preventing uncontrolled lowering of a load should a line failure occur within a hydraulic system. The load is attached to a piston rod which extends out of a hydraulic cylinder having a movable piston therein. The movable piston divides the cylinder into a head end and a rod end. The system includes a source of pressurized fluid, a control valve for selectively controlling the flow of this pressurized fluid to an end of the hydraulic cylinder and first and second valves connected to the hydraulic cylinder. The pair of valves are biased towards a closed position by a common fluid pressure taken downstream of the second valve and are urged towards an open position by fluid pressure taken upstream of the first valve. The valves are also adjusted to move in a proportional manner with the second valve opening first.

The general object of this invention is to provide a load control system which will prevent the uncontrolled lowering of a load should a line failure occur within a hydraulic system. A more specific object of this invention is to provide a load control system which uses a pair of proportionally adjusted valves to control fluid flow out of a hydraulic cylinder based on the flow directed into that cylinder.

Another object of this invention is to provide a load control system which uses a pair of valves directly connected to the hydraulic cylinder and both of which are mornally biased towards a closed position.

A further object of this invention is to provide a simple and economical load control system for preventing the uncontrolled lowering of a load in a hydraulic system.

Other objects and advantages of the present invention will become more apparent to those skilled in the art in view of the following description and the accompanying drawing.

DETAILED DESCRIPTION OF THE PREFERRED EMBODIMENTS

Figure 1:
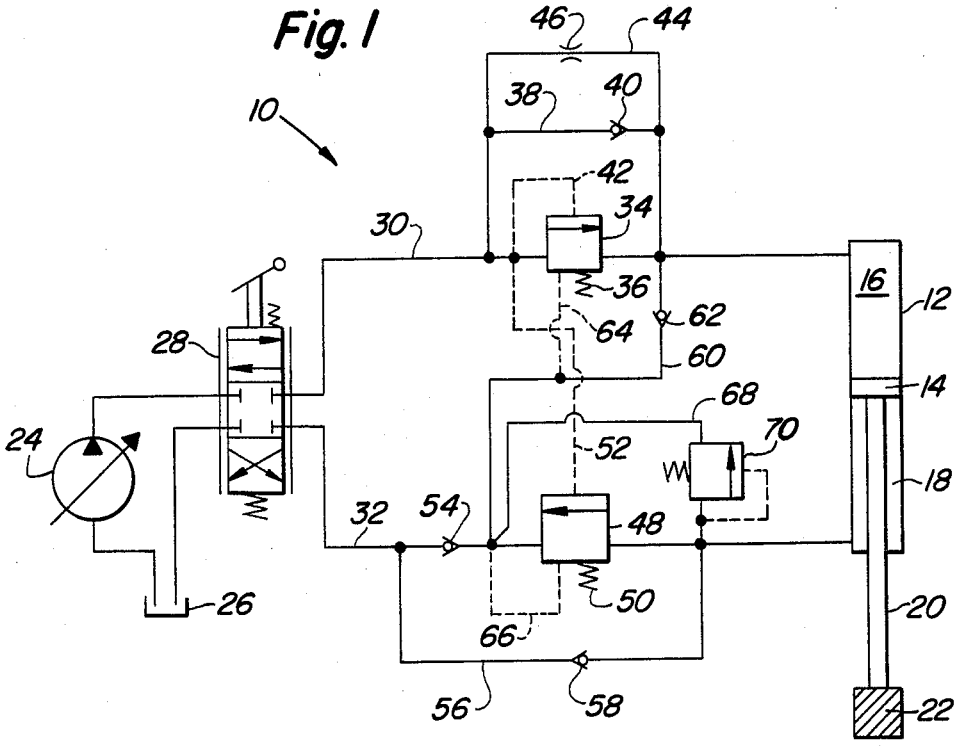
FIG. 1 is a schematic of a load control system.

Referring to FIG. 1, a load control hydraulic system 10 is depicted having a hydraulic cylinder 12 with a movable piston 14 therein. The piston 14 divides the hydraulic cylinder 12 into a head end 16 and a rod end 18. A piston rod 20 is attached to the piston 14 and extends out of the hydraulic cylinder 12 to support a load 22.

The load control system 10 includes a pump 24, fluidly connected to a reservoir 26, for supplying pressurized fluid to an end of the hydraulic cylinder 12. A manually operable control valve 28 is positioned downstream of the pump 24 and is fluidly connected to both the head end 16 and the rod end 18 of the hydraulic cylinder 12 by lines 30 and 32, respectively. The control valve 28, which is preferably a four-way, three-position valve with inlet metering, is movable so as to direct fluid flow to either end of the hydraulic cylinder 12 and to permit return fluid from the opposite end of the hydraulic cylinder 12 to return to the reservoir 26. Positioned between the control valve 28 and the head end 16 of the hydraulic cylinder 12 is a sequence valve 34 which is biased by a spring 36 to a closed position thereby normally preventing fluid flow therethrough.

A bypass passage 38 straddles the sequence valve 34 and has a one-way check valve 40 positioned thereacross which permits fluid flow out of the head end 16 of the hydraulic cylinder 12 towards the control valve 28 but prevents fluid flow in a reverse direction. Branching off the line 30 is a pilot passage 42 which is connected to the sequence valve 34 such that it can supply pressurized fluid to an area thereof, which area is in direct opposition to the spring 36. As the pressure within the pilot passage 42 overcomes the force of the spring 36, the sequence valve 34 will move towards its open position thereby permitting fluid flow from the control valve 28 to the head end 16 of the hydraulic cylinder 12. The amount the sequence valve 34 opens and the pressure in the passages 30, 38 and 42 is dependent on the fluid flow from the control valve 28 directed to the head end 16 of the hydraulic cylinder 12. A bypass bleed passage 44 is connected in parallel with the bypass passage 38 across the sequence valve 34 and has an orifice 46 positioned thereacross, the function of which will be explained shortly.

The load control system 10 also includes a load holding valve 48 positioned across the line 32. The load holding valve 48 is biased by a spring 50 towards a closed position thereby normally preventing fluid flow out of the rod end 18 of the hydraulic cylinder 12. The load holding valve 48 is movable towards an open position by fluid pressure conveyed through a pilot sense passage 52. The pilot sense passage 52 connects the load holding valve 48 to a point located upstream of the sequence valve 34. As the pressure within the pilot sense passage 52 increases and overcomes the force of the spring 50, the load holding valve 48 will move towards its open position thereby permitting fluid flow out of the rod end 18 of the hydraulic cylinder 12 and through the control valve 28 to the reservoir 26. A second check valve 54 is positioned across the line 32 downstream of the load holding valve 48. This second check valve 54 permits fluid flow to pass from the load holding valve 48 to the control valve 28 but prevents fluid flow in a reverse direction. Therefore, in order to provide flow from the control valve 28 to the rod end 18 of the hydraulic cylinder 12, a bypass line 56 is present. The bypass line 56 straddles both the load holding valve 48 and the second check valve 54 and permits fluid to flow into the rod end 18 of the hydraulic cylinder 12 when the operator desires to raise the load 22. A third check valve 58 is positioned across the bypass line 56 and operates to prevent fluid flow from the rod end 18 of the hydraulic cylinder 12 from bypassing the load holding valve 48 in flowing to the control valve 28.

An anti-cavitation line 60 is also present which fluidly joins a point located downstream of the load holding valve 48 and upstream of the second check valve 54 to the downstream side of the sequence valve 34. This anti-cavitation line 60 is designed to route fluid that has passed through the load holding valve 48 to the head end 16 of the hydraulic cylinder 12 and will prevent cavitation from occurring therein. A fourth check valve 62 is positioned across the anti-cavitation line 60 and prevents fluid flow from the downstream side of the sequence valve 34 from flowing to the downstream side of the load holding valve 48.

It should be noted that the phrase "upstream" and "downstream" has been used above to describe the flow of fluid from the control valve 28 to the head end 16 of the hydraulic cylinder 12 and from the rod end 18 back to the reservoir 26. However, the control valve 28 can meter flow to either end of the hydraulic cylinder 12 and therefore when the direction is reversed, the upstream and downstream positions of the valves 34 and 48 will also be reversed.

The control valve 28 is an inlet metering valve which means that the line 32 opens to the reservoir 26 before a pressure port within the control valve 28 opens to permit fluid flow to the line 30. The inlet metering feature means that the pressure in the line 32 will be substantially less than the pressure in the line 30 when the load 22 is being lowered. Since the pressure in the line 32 is always low, should the line 32 fail, then the pressure in the line 32 and consequently the pressure downstream of the load holding valve 48 would not change significantly. Thus, the opening of the sequence valve 34 and the opening of the load holding valve 48 would not change significantly. Since the rate at which the piston rod 20 extends out of the hydraulic cylinder 12 is dependent upon the opening of the sequence valve 34 and upon the opening of the load holding valve 48, the extension rate would not change significantly if the line 32 were to fail.

The load control system 10 further includes a pair of sense passages 64 and 66 which branch off the anti-cavitation line 60 nd which are connected to the sequence valve 34 and the load holding valve 48 respectively. The sense passages 64 and 66 convey pressurized fluid to both valves 34 and 48 for urging them towards the closed positions and for assuring that a common pressure valve will act on each valve so that both will move proportionally. This is very important because it assures that the piston 14 will move in a gradual fashion rather than abruptly. It should also be noted that the load holding valve 48 is sized such that the load holding valve 48 will move towards the open position momentarily before the sequence valve 34 does. Such action assures that the fluid within the rod end 18 of the hydraulic cylinder 12 will be provided with an exit before additional pressurized fluid is routed to the head end 16 of the hydraulic cylinder 12. This enables the piston 14 to move in a gradual fashion and prevents pressure from building in the head end 16 of the hydraulic cylinder 12. This feature also allows the load 22 to bounce somewhat without effecting the pressure in the lines 30, 42 and 52. Accordingly, the opening of the load holding valve 48 will remain uneffected by any bounce of the load 22 and this provides for a smooth operation.

The sequence valve 34 and the load holding valve 48 operate proportionally such that both are urged towards an open position by a common fluid pressure and towards a closed position by a different but still common fluid pressure. The sequence valve 34 is set in relation to the load holding valve 48 in a manner such that, at any and all operating speeds, the flow passing through the sequence valve 34 is insufficient to fill the volume in the head end 16 of the hydraulic cylinder 12 created by the downward movement of the piston 14 due to the fluid passing out of the rod end 18 and through the opening of the load holding valve 48. In this manner, the head end 16 of the hydraulic cylinder 12 remains at a pressure value less than the pressure in the line 30. The proportionality of the valves 34 and 48 also assures that they will open in a smooth and controlled fashion.

A relief line 68 can also be employed that straddles the load holding valve 48. Positioned across this relief line 68 is relief valve 70 which is normally spring-biased to a closed position. The relief valve 70 is set to a predetermined value so as to relieve pressurized fluid from the rod end 18 of the hydraulic cylinder 12 should the pressure upstream of the load holding valve 48 exceed the predetermined value. When the pressure in the rod end 18 of the hydraulic cylinder 12 rises to a value high enough to open the relief valve 70, the fluid passes through the relief valve 70 and through the lines 68 and 60 to the head end 16 of the hydraulic cylinder 12.

Figure 2:
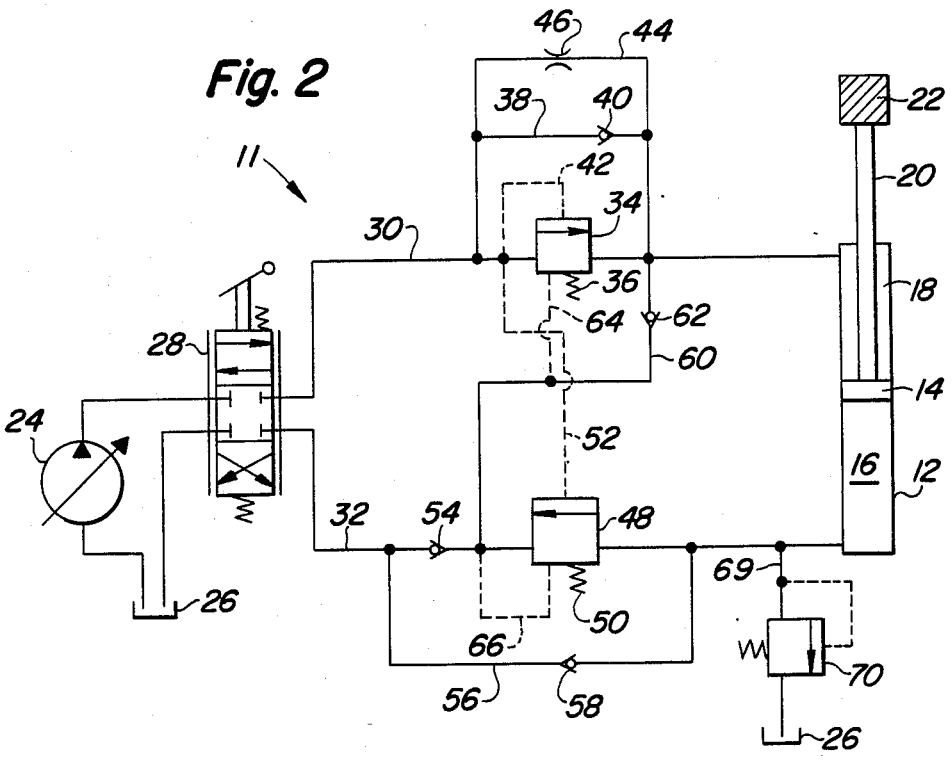
FIG. 2 is a schematic of an alternative load control system.

Referring to FIG. 2, a load control hydraulic system 11 is depicted wherein the load 22 is moved upwards as the head end 16 of the hydraulic cylinder 12 is filled. FIG. 2 also differs from FIG. 1 in that the relief valve 70 is connected directly to the reservoir 26 by line 69 branching off the line 32. This is necessary because the volume in the rod end 18 of the hydraulic cylinder 12 is not adequate to accept the greater volume relieved from the head end 16. This arrangement allows pressurized fluid above a predetermined value to be removed from the system before it can cause physical damage.

OPERATION

The operation of the load control system 10 will now be explained in reference to FIG. 1 starting from a position wherein the control valve 28 is in a neutral position and the piston 14 is located approximately in the middle of the hydraulic cylinder 12. Assuming that the operator wishes to lower the load 22, he would move the control valve 28 downwards, proportional to the downward lowering speed desired, such that the pressurized fluid from the pump 24 can be routed through the line 30 to the sequence valve 34. Since the control valve 28 is an inlet metering valve, the return port to the reservoir 26 would open before the pressure port to the line 30.

As the pressure within the line 30 builds, it will be sensed at the sequence valve 34 via the pilot passage 42, at the orifice 46 via the bypass bleed passage 44, and at the load holding valve 48 via the pilot sense passage 52. The orifice 46 would permit limited flow therethrough but as the operator continued to move the control valve 28 to an open position, the pressure would build to a point wherein the load holding valve 48 would begin to open momentarily before the sequence valve 34. With the load holding valve 48 open, pressurized fluid from the rod end 18 of the hydraulic cylinder 12 will pass therethrough and then through the line 32 and the control valve 28 to the reservoir 26. Fluid will also pass from the line 32 to the head end 16 of the hydraulic cylinder 12 via the anti-cavitation line 60. Simultaneously, pressurized fluid will pass through the line 30 and the sequence valve 34 to the head end 16 of the hydraulic cylinder 12. As can be seen from FIG. 1, as the piston 14 is being lowered, fluid leaving the load holding valve 48 will pass through the anti-cavitation line 60 and through both of the sense passages 64 and 66. This common pressure in the sense passages 64 and 66 assists the springs 36 and 50 in urging the valves 34 and 48 to their closed positions and assures that the valves 34 and 48 move in a proportional manner relative to one another.

After the operator has lowered the load 22 a desired amount, he would move the control valve 28 ack to its neutral position. With the control valve 28 blocking off fluid flow from the pump 24, the pressure in the line 30 would decrease by bleeding past the orifice 46 and both the load holding valve 48 and the sequence valve 34 would move back towards their closed position under the influence of the force of the springs 36 and 50, respectively, and the fluid pressure in the sense passages 64 and 66, respectively. The fluid that passes through the orifice 46 will enter the head end 16 of the hydraulic cylinder 12. The fluid pressure present upstream of the sequence valve 34 will then diminish to a state where it is insufficient to keep the sequence valve 34 or the load holding valve 48 in the open position.

Should the operator wish to raise the load, he would move the control valve 28 upwards such that the pressurized fluid from the pump 24 would be routed through the line 32 and the bypass line 56 to the rod end 18 of the hydraulic cylinder 12. As this occurs, the fluid in the head end 16 of the hydraulic cylinder 12 would pass through the check valve 40 and the bypass passage 38 to the line 30 and subsequently back through the control valve 28 to the reservoir 26. Some fluid will also pass from the head end 16 of the hydraulic cylinder 12 through the bypass bleed passage 44 and the orifice 46 to the line 30 and subsequently back through the control valve 28 to the reservoir 26. It should be noted that during the raising of the load, both the sequence valve 34 and the load holding valve 48 remain in their closed position.

The operation of the system shown in FIG. 2 is similar to that discussed above except that the load would be moved upward as the head end 16 of the hydraulic cylinder is filled and would move downward as the rod end 18 of the hydraulic cylinder 12 is filled.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

We claim:

1. A load control system for preventing the uncontrolled lowering of a load should a line failure occur in said system, said load being attached to a piston rod extending out of a hydraulic cylinder, said hydraulic cylinder having a movable piston therein dividing said hydraulic cylinder into a first end and a second end, said system comprising:

(a) a source of pressurized fluid;

(b) control valve means for selectively controlling the flow of pressurized fluid from said source to an end of said hydraulic cylinder; and (c) first and second valves connected between said control valve means and said first end and said second end, respectively, of said hydraulic cylinder, each of said valves being biased toward a closed position by a common fluid pressure and each of said valves being urged toward an open position by a different common fluid pressure, said valves being sized to open and close in a proportional manner relative to one another with said second valve opening first when said load is to be lowered thereby permitting said load to be lowered in a controlled manner.

2. A load control system for preventing the uncontrolled lowering of a load should a line failure occur in said system, said load being attached to a piston rod extending out of a hydraulic cylinder, said hydraulic cylinder having a movable piston therein dividing said hydraulic cylinder into a first end and a second end, said system comprising:

(a) a source of pressurized fluid;

(b) control valve means for selectively controlling the flow of pressurized fluid from said source to an end of said hydraulic cylinder; and (c) first and second valves connected between said control valve means and said first end and second end, respectively, of said hydraulic cylinder, each of said valves being biased toward a closed position by both a spring force and by a common fluid pressure and each of said valves being urged toward an open position by a different common fluid pressure, said valves being sized to open and close in a proportional manner relative to one another with said second valve opening first when said load is to be lowered thereby permitting said load to be lowered in a controlled manner.

3. A load control system for preventing the uncontrolled lowering of a load should a line failure occur in said system, said load being attached to a piston rod extending out of a hydraulic cylinder, said hydraulic cylinder having a movable piston therein dividing said hydraulic cylinder into a first end and a second end, said system comprising:

(a) a source of pressurized fluid;

(b) control valve means for selectively controlling the flow of pressurized fluid from said source to an end of said hydraulic cylinder;

(c) first and second valves positioned between said control valve means and said first end and said second end, respectively, of said hydraulic cylinder, each of said valves being biased toward a closed position by a common fluid pressure and each of said valves being moved towards an open position by a higher common fluid pressure, said valves being sized to open and close in a proportional manner with said second valve opening first when said load is to be lowered thereby permitting said load to be lowered in a controlled manner;

(d) a check valve positioned between said second valve and said control valve means which prevents pressurized fluid from said control valve means from flowing therethrough;

(e) an anti-cavitation line fluidly joining a point located between said second valve and said check valve to said first end of said hydraulic cylinder to prevent cavitation from occurring therein, said anti-cavitation line having check means positioned thereacross to prevent fluid flow in a reverse direction;

(f) a first passage straddling said first valve and having means positioned thereacross for both permitting fluid flow from said first end of said hydraulic cylinder to said control valve means and for limiting fluid flow in an opposite direction; and (g) a second passage straddling both said second valve and said check valve, said second passage having a one-way check valve positioned thereacross which permits fluid flow from said control valve means to said second end of said hydraulic cylinder and which prevents fluid flow in an opposite direction.

4. The load control system of claim 3 wherein said control valve means is an inlet metering four-way, three-position valve.

5. The load control system of claim 3 wherein a relief line straddles said second valve and a relief valve is positioned thereacross for relieving fluid pressure above a predetermined value from said rod end of said hydraulic cylinder.

6. The load control system of claim 3 wherein both of said first and second valves are spring biased toward closed positions.

7. The load control system of claim 3 wherein said means positioned across said first passage includes a one-way check valve arranged in a parallel relationship with said orifice.

8. The load control system of claim 3 wherein said means positioned across said second passage is a one-way check valve.

9. The load control system of claim 3, wherein a relief line is fluidly connected between said second end of said hydraulic cylinder and said second valve and a relief valve is positioned thereacross for relieving fluid pressure above a predetermined value from said head end of said hydraulic cylinder.

10. A load control system for preventing the uncontrolled lowering of a load should a line falure occur in said system, said load being attached to a piston rod extending out of a hydraulic cylinder, said hydraulic cylinder having a movable piston therein dividing said hydraulic cylinder into a first end and a second end, said system comprising:

(a) a source of pressurized fluid;

(b) a control valve connected to said source of pressurized fluid for selectively controlling the flow of pressurized fluid from said source to an end of said hydraulic cylinder;

(c) first and second normally closed valves positioned between said control valve and said first end and second end, respectively, of said hydraulic cylinder;

(d) a pilot passage connecting said control valve to said first valve for conveying pressuirized fluid thereto which urges said first valve to move toward an open position;

(e) a first passage straddling said first valve and having a first one-way check valve positioned thereacross which permits fluid flow from said first end of said hydraulic cylinder to said control valve while preventing fluid flow in an opposite direction;

(f) a pilot bleed passage connected across said first valve in paralell relationship with said first passage, said pilot bleed passage having an orifice positioned thereacross which permits limited fluid flow therethrough with a drop in pressure;

(g) a pilot sense passage connecting a point located between said control valve and said first valve to said second valve, said pilot sense passage conveying pressurized fluid to said second valve which urges said second valve to move toward an open position thereby permitting fluid in said second end of said hydraulic cylinder to be routed back through said control valve to said reservoir;

(h) a second one-way check valve positioned between said second valve and said control valve which permits fluid flow from said second valve to said control valve while preventing fluid flow in an opposite direction;

(i) a bypass line straddling both said second valve and said second check valve for fluidly connecting said control valve to said second end of said hydraulic cylinder;

(j) a third one-way check valve positioned across said bypass line which permits fluid flow from said control valve to said second end of said hydraulic cylinder while preventing fluid flow in an opposite direction;

(k) an anti-cavitation line fluidly joining a point located between said second valve and said second check valve to a point located between said first valve and said first end of said hydraulic cylinder whereby additional fluid is routed to said first end of said hydraulic cylinder to prevent cavitation from occurring therein;

(l) a fourth one-way check valve positioned across said anti-cavitaton line which permits fluid flow from said second valve to a point adjacent said first end of said hydraulic cylinder while preventing fluid flow in an opposite direction; and (m) a pair of sense passages branching off said anti-cavitation line which are connected to said first and said second valves, said pair of sense passages conveying pressurized fluid to assist in urging both valves toward said closed positions and for assuring that a common fluid pressure will act on each valve such that both valves will move proportionally with said second valve opening first when said load is to be lowered.

11. The load control system of claim 10 wherein a relief line straddles said second valve and a relief valve is positioned thereacross for relieving fluid pressure above a predetermined value from said rod end of said hydraulic cylinder.

12. The load control system of claim 10 wherein both said first and second valves are spring biased toward closed positions.

13. The load control system of claim 10 wherein said control valve is a four-way, three-position control valve.

14. The load control system of claim 10 wherein a relief line is fluidly connected between said second end of said hydraulic cylinder and said second valve and a relief valve is positioned thereacross for relieving fluid pressure above a predetermined value from said head end of said hydraulic cylinder.

* * * * *